US008317557B2

(12) United States Patent
Dudarenke et al.

(10) Patent No.: US 8,317,557 B2
(45) Date of Patent: Nov. 27, 2012

(54) ANTI-INGESTION SYSTEM FOR A MARINE DRIVE

(75) Inventors: Jeffrey J. Dudarenke, Fond du Lac, WI (US); David J. Hilbert, Black Creek, WI (US); Matthew W. Jaeger, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 228 days.

(21) Appl. No.: 12/897,129

(22) Filed: Oct. 4, 2010

(65) Prior Publication Data

US 2012/0083176 A1 Apr. 5, 2012

(51) Int. Cl.
*B63H 21/38* (2006.01)

(52) U.S. Cl. ..... 440/89 R; 60/324

(58) Field of Classification Search ..... 440/89 R, 440/88 A, 88 J, 89 A, 89 C; 60/310, 324, 60/321, 322, 323

See application file for complete search history.

(56) References Cited

U.S. PATENT DOCUMENTS

| | | | | |
|---|---|---|---|---|
| 4,178,873 | A | 12/1979 | Bankstahl | |
| 4,498,876 | A | 2/1985 | Zemlicka | |
| 4,526,002 | A | 7/1985 | Bibow | |
| 4,831,822 | A * | 5/1989 | Yoshimura | 60/310 |
| 6,077,137 | A | 6/2000 | Hahn | |
| 6,500,038 | B1 | 12/2002 | Jaeger et al. | |
| 6,571,753 | B1 | 6/2003 | Jaeger | |
| 6,638,124 | B2 | 10/2003 | Zoubul et al. | |

* cited by examiner

*Primary Examiner* — Lars A Olson
(74) *Attorney, Agent, or Firm* — Andrus, Sceales, Starke & Sawall, LLP

(57) ABSTRACT

An anti-ingestion system is provided for a marine drive with a submerged exhaust outlet. An anti-ingestion valve is operated by differential pressure thereacross to a closed condition when the engine is operating in an on state and cooling water is being pumped through a water conduit to an exhaust mixing point, with the anti-ingestion valve blocking passage of cooling water therepast in the noted closed condition. The anti-ingestion valve is operated by differential pressure thereacross to an open condition when the engine is in an off state, and permits passage of air therethrough and communicates atmospheric pressure through the water conduit to the exhaust mixing point to relieve vacuum in the exhaust system.

13 Claims, 6 Drawing Sheets

ANTI-INGESTION SYSTEM FOR A MARINE DRIVE

BACKGROUND AND SUMMARY

The invention relates to marine drives with submerged exhaust outlets, and more particularly to anti-ingestion systems for preventing ingestion of water into the marine drive internal combustion engine after turn-off.

Various types of marine drives have an internal combustion engine having an exhaust system, and a cooling system drawing cooling water from the body of water in which the marine drive is operating. The exhaust system may discharge engine exhaust through the drive and through the propeller. After turn-off of the engine, and upon cool down of the exhaust gas that is trapped between the engine combustion chamber and the submerged exhaust outlet through the propeller, e.g. 10 to 20 minutes, a vacuum may be created in the exhaust system which may draw water back into the engine, which is deleterious to the engine. This water may cause hydrolock upon attempted re-start of the engine, or cause corrosion on an exhaust valve, leading to engine durability issues, or damage emissions compliance hardware.

The present invention arose during continuing development efforts in the above technology.

DETAILED DESCRIPTION

Figure 1:
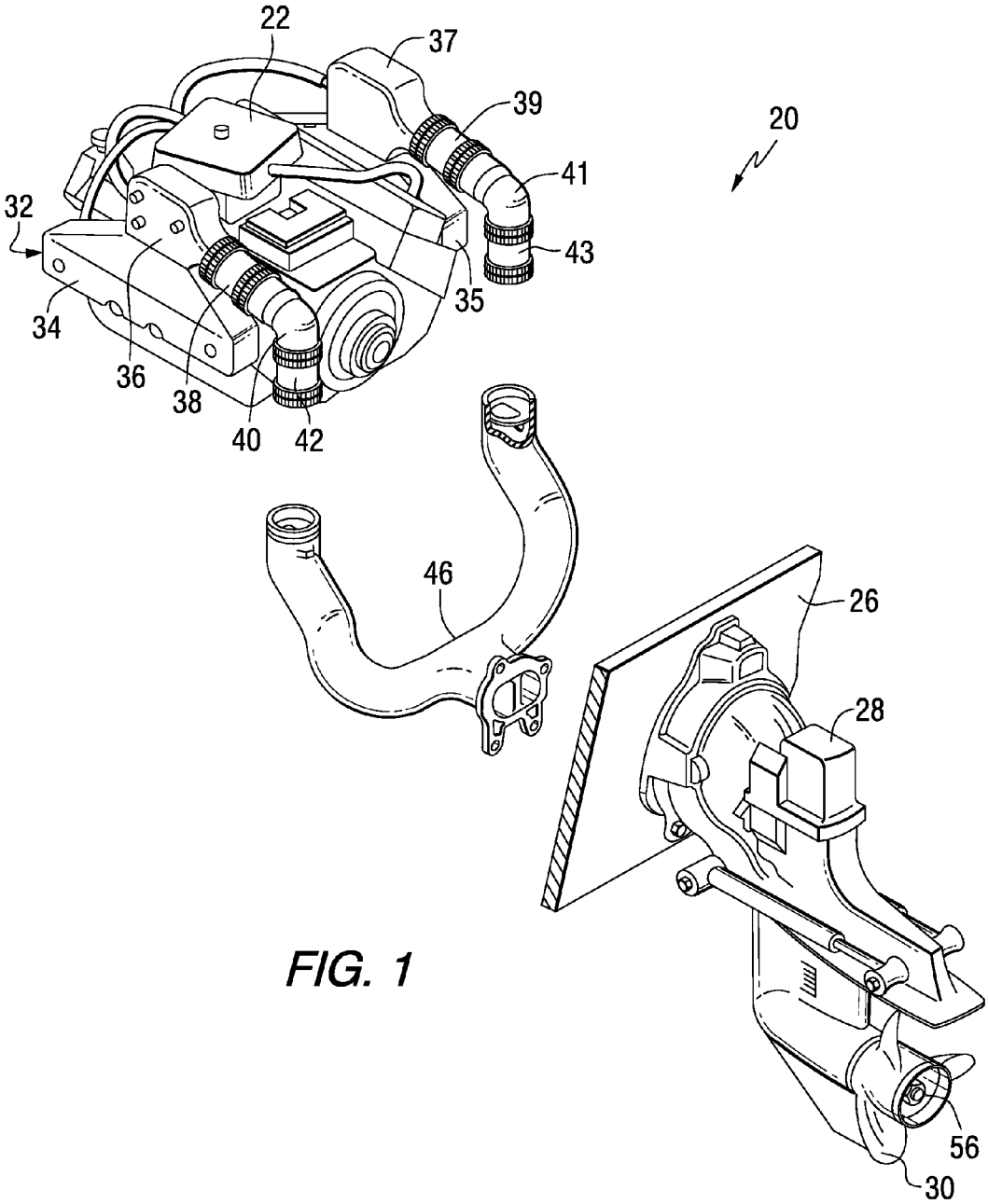
FIG. 1 is a perspective exploded view of a sterndrive marine drive, and is taken from U.S. Pat. No. 4,498,876, incorporated herein by reference.
Figure 2:
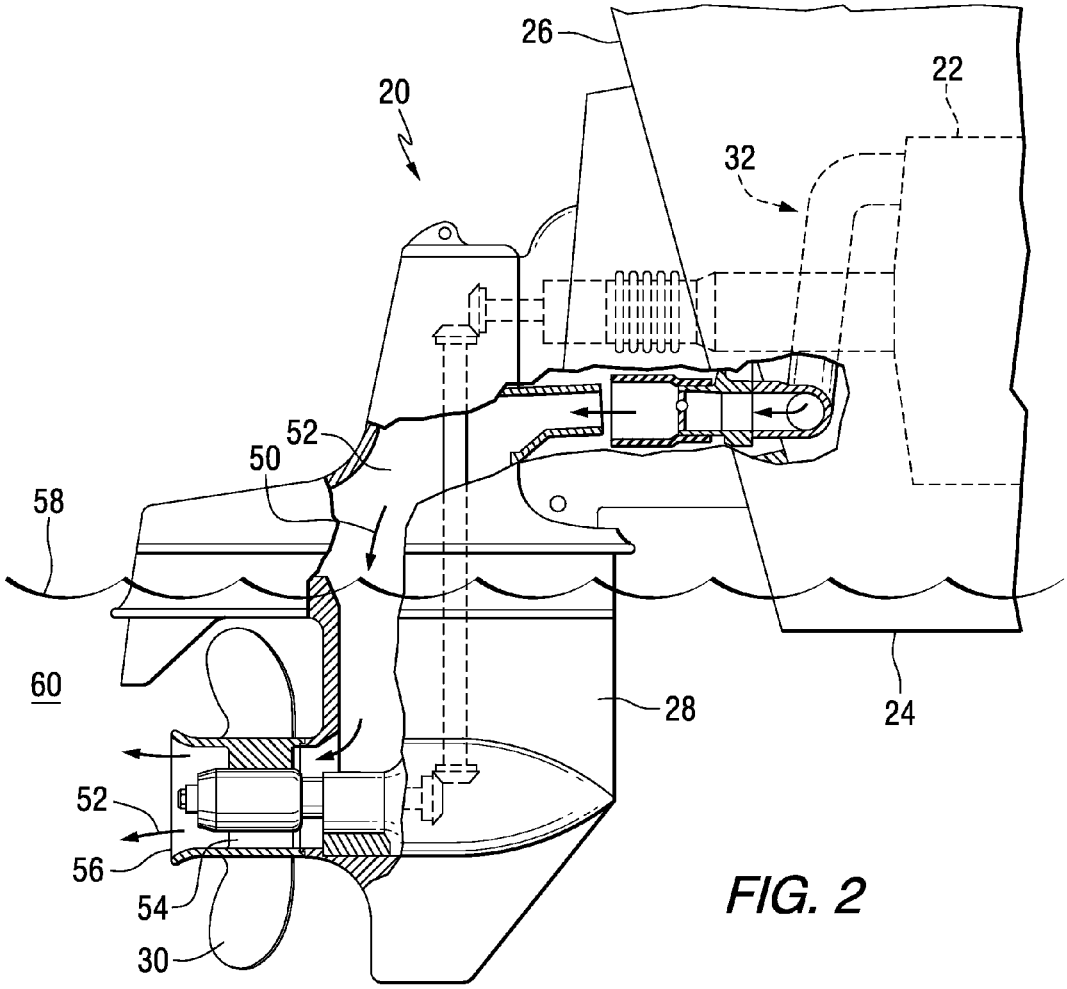
FIG. 2 is a fragmentary side elevation view of a sterndrive with parts broken away, and is taken from U.S. Pat. No. 4,178,873, incorporated herein by reference.

FIGS. 1 and 2 show a marine drive 20, in one embodiment a sterndrive having an inboard internal combustion engine 22 in a vessel 24 having a transom 26 and operatively connected in torque transmitting relation with an outdrive 28 driving a propeller 30 to propel the vessel. The engine has an exhaust system 32 including port and starboard exhaust manifolds 34 and 35, port and starboard exhaust elbows 36 and 37 connected by respective flexible exhaust bellows 38 and 39 and respective turned connector pipes 40 and 41 and respective flexible exhaust bellows 42 and 43 to U-shaped or Y-shaped exhaust pipe 46 connected through transom 26 to outdrive 28 for passage therethrough as shown at arrows 50 in exhaust passage 52 for discharge through propeller hub exhaust passage 54 at submerged exhaust outlet 56, all as is conventional. The exhaust system discharges exhaust at exhaust outlet 56 below the surface 58 of a body of water 60 in which the vessel 24 and marine drive 20 are operating.

Figure 3:
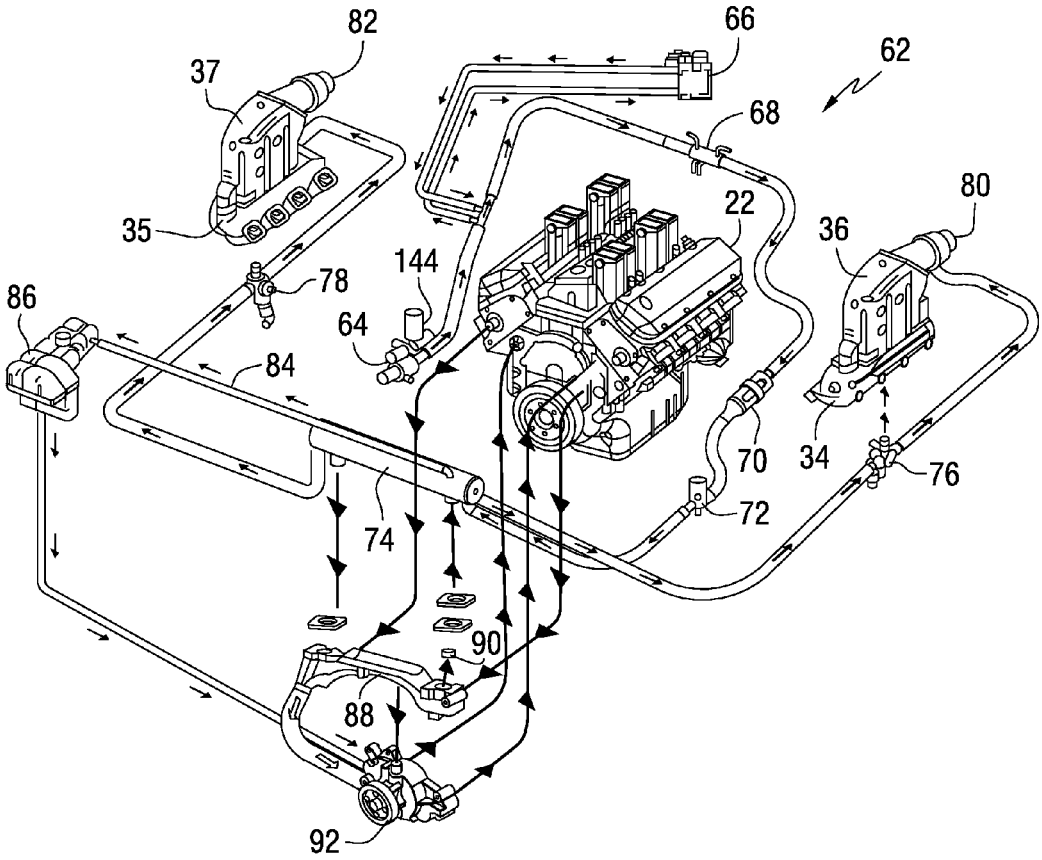
FIG. 3 is a schematic drawing of a marine drive cooling system.

The marine drive has a cooling system 62, FIG. 3, having a seawater pump 64 drawing cooling water from the body of water 60 in which the marine drive is operating and pumping the cooling water through a fuel supply cooler 66, a power steering cooler 68, an oil cooler 70, a drain valve 72, an engine heat exchanger 74, and then through pressure relief valves 76 and 78 to respective port and starboard exhaust manifolds 34 and 35 having respective port and starboard exhaust elbows 36 and 37, which cooling water then is discharged into and mixes with exhaust from the respective exhaust elbow outlets 80 and 82 and then is returned to the body of water 60 with the exhaust through outdrive exhaust passage 52 and propeller hub exhaust passage 54 to submerged exhaust outlet 56, as is conventional. Engine heat exchanger 74 transfers heat from and cools ethylene glycol coolant flowing in closed cooling system 84 of the engine, which includes coolant reservoir 86, cross-over coolant conduit 88, thermostat 90, and circulating pump 92, as is conventional.

Figure 4:
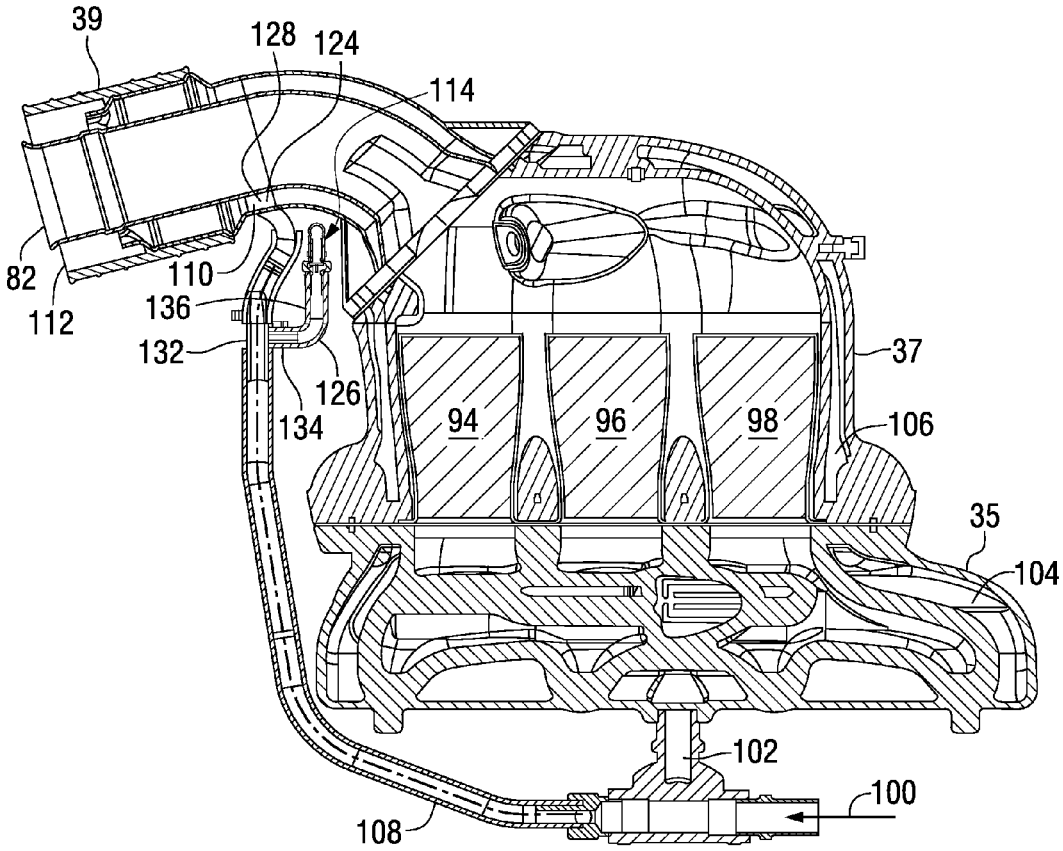
FIG. 4 is an enlarged sectional view of a component of FIG. 3.
Figure 5:
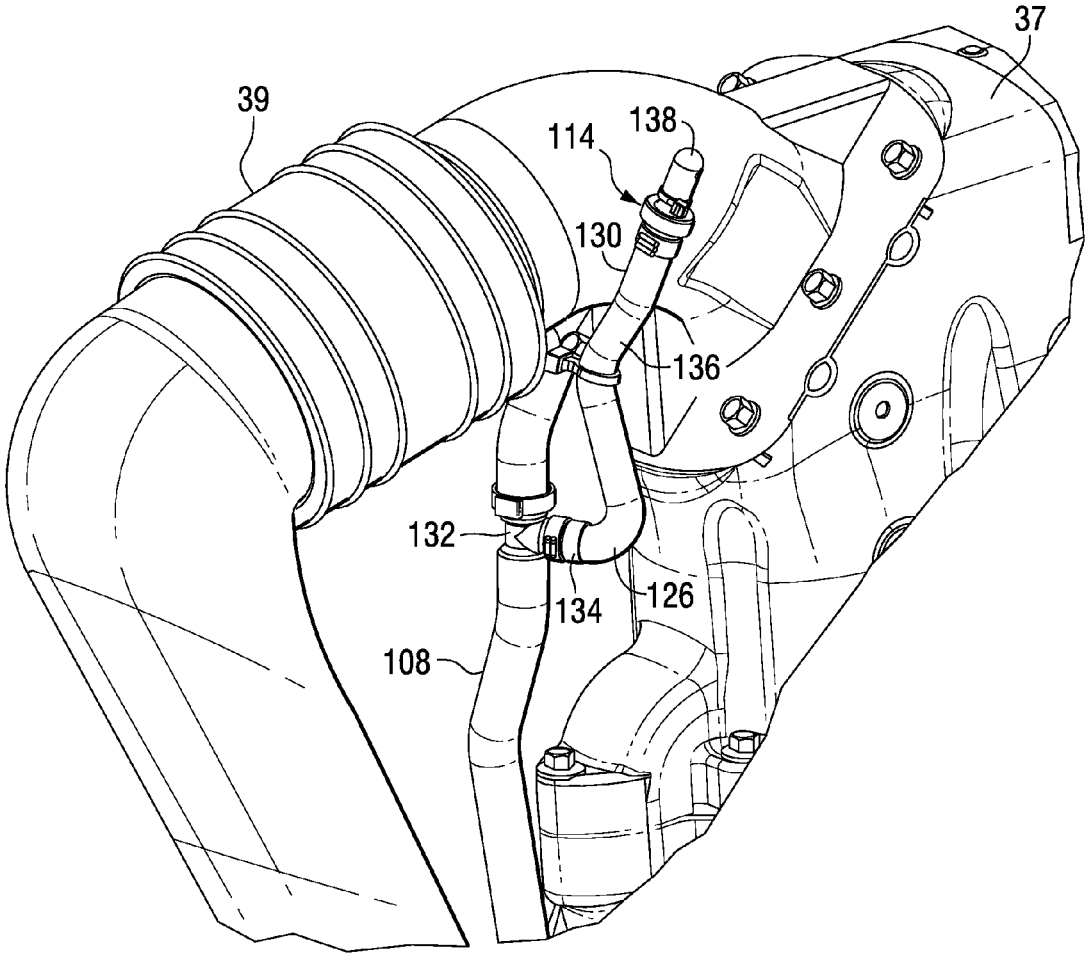
FIG. 5 is a perspective view of a portion of the assembly of FIG. 4.
Figure 6:
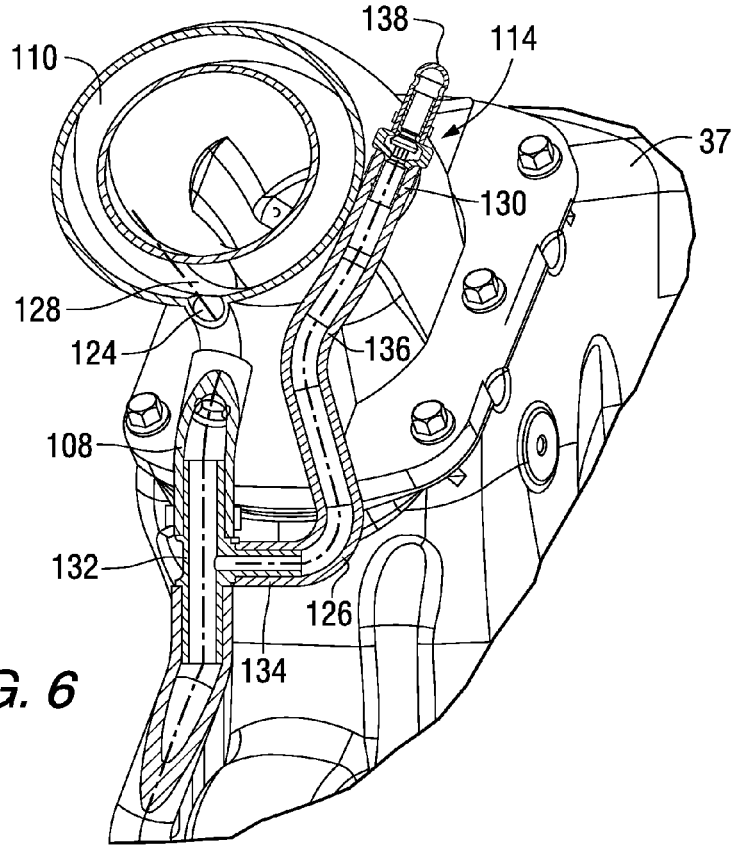
FIG. 6 is a perspective view from a different angle of a portion of the assembly of FIG. 5 partially cutaway.
Figure 7:
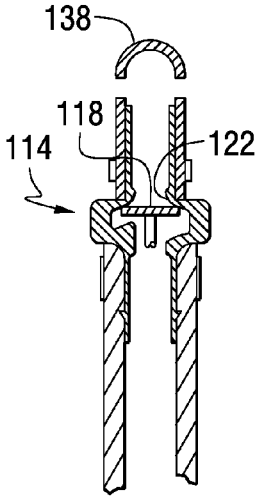
FIG. 7 is an enlarged sectional view of a portion of the assembly of FIG. 6.

FIGS. 4-6 show exhaust manifold 35 and exhaust elbow 37, with the other exhaust manifold 34 and exhaust elbow 36 being the same. The assembly includes catalytic elements such as 94, 96, 98 for treating the exhaust passing upwardly therethrough and then turning at the top of the elbow and passing leftwardly in FIG. 4 to the exhaust elbow outlet at 82. The cooling water flows as shown at arrow 100 and passage 102 into exhaust manifold 35 and its cooling jacket 104 and then to exhaust elbow 37 and its cooling jacket 106, as is conventional. The cooling water also flows through a bypass water conduit 108 to cooling jacket 110 to discharge into and mix with exhaust from the exhaust system at exhaust mixing point 112 at outlet 82 of the exhaust elbow 37. An anti-ingestion valve 114, FIGS. 5-8, is connected in communication with water conduit 108 and is operated by differential pressure across the valve to a closed condition, FIG. 7, when the engine is operating in an on state and cooling water is being pumped by pump 64 through water conduit 108 to exhaust mixing point 112. The anti-ingestion valve in the closed condition blocks passage of cooling water therepast. The anti-ingestion valve is operated by differential pressure thereacross to an open condition, FIG. 8, when the engine is in an off state and cooling water is not being pumped through water conduit 108 to exhaust mixing point 112. Actuation of the anti-ingestion valve 114 to the open condition occurs after engine turn-off and upon cool down of the exhaust gas (e.g. 10 to 20 minutes) that is trapped between the engine combustion chamber and the submerged exhaust outlet 56, which cool down creates a vacuum in the exhaust system, which vacuum provides the differential pressure which actuates anti-ingestion valve 114 to the noted open condition, FIG. 8. Anti-ingestion valve 114 in the noted open condition permits passage of air therethrough as shown at arrow 116, FIG. 8, to communicate atmospheric pressure through water conduit 108 to relieve vacuum in the exhaust system.

Figure 8:
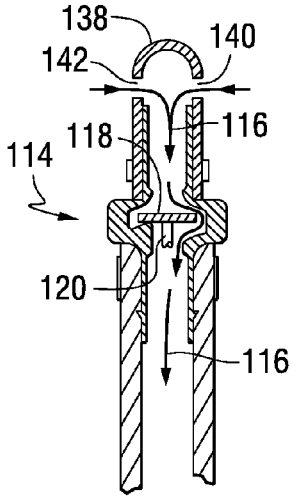
FIG. 8 is like FIG. 7 and shows a different operational condition.
Figure 9:
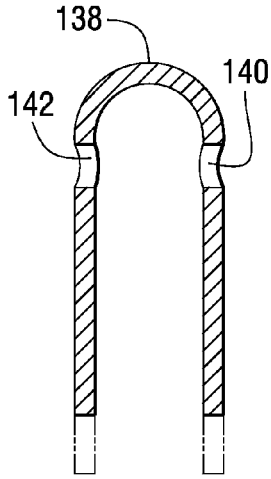
FIG. 9 is an enlarged view of a portion of the assembly of FIG. 7.

In one embodiment, anti-ingestion valve 114 is a diaphragm check valve, though other types of check valves may be used, for example a ball check valve and the like. FIG. 8 shows a diaphragm 118 in an open condition, with atmospheric passing as shown at arrow 116 around diaphragm 118 and through radially aligned slots or apertures in the lower valve seat and guide legs such as 120 extending downwardly from the diaphragm. In the closed condition of the valve, diaphragm 118 moves upwardly to seat against valve seat 122 in sealing relation, to block the flow of atmospheric air downwardly therepast, and also to block the flow of cooling water upwardly therepast. Movable valve member 118 moves in a first direction, namely upwardly, to the noted closed condition, FIG. 7, and moves in a second opposite direction, namely downwardly, to the open condition, FIG. 8. Valve member 118 moves in each of the noted first and second, namely upward and downward, directions in response to differential pressure and without a biasing spring. The anti-ingestion valve is actuated to the open condition, FIG. 8, after turn-off of the engine and upon cool down of the exhaust gas as noted above, creating a vacuum, and remains in the open condition of FIG. 8 until the next turn-on of the engine.

Anti-ingestion valve 114 is located along water conduit 108, FIGS. 4-6, in sufficiently close proximity to the exhaust mixing point 112 to quickly communicate vacuum in the exhaust system to the anti-ingestion valve. Water conduit 108 is connected at a connection point 124, FIGS. 4, 6, to exhaust elbow water jacket 110 to flow to exhaust mixing point 112, and anti-ingestion valve 114 is located within 100±50 mm (millimeters) of connection point 124. In one embodiment, the anti-ingestion valve is operated between the noted open and closed conditions in response to 75±25 mm water column pressure. The anti-ingestion valve is located along water conduit 108 in sufficiently close proximity to the exhaust mixing point to minimize the amount of water which must be evacuated when the anti-ingestion valve changes from the closed condition to the open condition to in turn provide rapid communication of atmospheric air pressure through the open anti-ingestion valve to the exhaust system at the exhaust mixing point, to relieve vacuum in the exhaust system. Anti-ingestion valve 114 is in a side branch conduit 126, FIG. 5, extending from water conduit 108. Exhaust elbow water jacket 110 has a lower segment 128, FIGS. 4, 6, passing the cooling water therethrough from water conduit 108 to mixing point 112. Side branch conduit 126 at anti-ingestion valve 114 extends at extension section 130 gravitationally above lower segment 128 of exhaust elbow water jacket 110. Anti-ingestion valve 114 is at a higher gravitational height than lower segment 128 of exhaust elbow water jacket 110. This is desirable in the event nuisance water leaks past diaphragm 118 when the engine is off, due to a few inches of water head above the valve adjacent the water jacket, which head pressure may be insufficient to consistently seal the diaphragm, hence allowing a possible leak. Raising the gravitational height of valve 114 above that of lower segment 128 of the exhaust elbow water jacket eliminates this possible leak.

In one embodiment, anti-ingestion valve 114 is connected to water conduit 108 at a Tee fitting 132, FIGS. 5, 6. In one embodiment, the noted side branch conduit 126 is a J-conduit having a lower hook leg 134 connected to water conduit 108 at Tee-fitting 132, and having an upper leg 136 extending upwardly from lower hook leg 134. Anti-ingestion valve 114 is located at upper leg 136. Movable valve member 118 moves up and down at upper leg 136 along the noted extension section 130. In one embodiment, extension section 130 above valve 114 is capped by a dust cap cover 138, FIGS. 5-9, having a pair of distally opposite ports or apertures 140 and 142 admitting atmospheric air thereinto as shown at arrows 116 in the open condition of the valve, FIG. 8. The dust cap prevents dust and debris from contaminating the valve diaphragm 118 which may be sensitive to small particles on the sealing surface against upper valve seat 122.

As is conventional, the cooling system may include a drain valve such as 144, FIG. 3, at the seawater pump 64. The drain valve has an open state draining the cooling system of cooling water when the engine is off including when the vessel is on the water and exhaust outlet 56, FIG. 2, is below the surface 58 of the body of water 60. Anti-ingestion valve 114 is in the noted open condition, FIG. 8, when drain valve 144 is in its open state, whereby to relieve possible vacuum in the cooling system and facilitate draining of cooling water therefrom.

In the foregoing description, certain terms have been used for brevity, clearness, and understanding. No unnecessary limitations are to be inferred therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims. Each limitation in the appended claims is intended to invoke interpretation under 35 U.S.C. §112, sixth paragraph, only if the terms "means for" or "step for" are explicitly recited in the respective limitation.

What is claimed is:

1. An anti-ingestion system for a marine drive having an internal combustion engine having an exhaust system discharging exhaust at an exhaust outlet below the surface of a body of water in which the marine drive is operating, and having a cooling system drawing cooling water from the body of water and pumping the cooling water through a water conduit to an exhaust mixing point to discharge into and mix with exhaust from said exhaust system, an anti-ingestion valve connected in communication with said water conduit, said anti-ingestion valve being operated by differential pressure thereacross to a closed condition when said engine is operating in an on state and said cooling water is being pumped through said water conduit to said exhaust mixing point, said anti-ingestion valve in said closed condition blocking passage of cooling water therepast, said anti-ingestion valve being operated by differential pressure thereacross to an open condition when said engine is in an off state and said cooling water is not being pumped through said water conduit to said exhaust mixing point, said anti-ingestion valve in said open condition permitting passage of air therethrough and communication of atmospheric pressure through said water conduit to said exhaust mixing point to relieve vacuum in said exhaust system wherein said anti-ingestion valve comprises a movable valve member moving in a first direction to said closed condition, and moving in a second opposite direction to said open condition, wherein said valve member moves in each of said first and second directions in response to differential pressure and without a biasing spring.

2. The anti-ingestion system according to claim 1 wherein said anti-ingestion valve is actuated to said open condition after turn-off of said engine, and remains in said open condition until next turn-on of said engine.

3. The anti-ingestion system according to claim 1 wherein said anti-ingestion valve comprises a diaphragm check valve.

4. An anti-ingestion system for a marine drive having an internal combustion engine having an exhaust system discharging exhaust at an exhaust outlet below the surface of a body of water in which the marine drive is operating, and having a cooling system drawing cooling water from the body of water and pumping the cooling water through a water conduit to an exhaust mixing point to discharge into and mix with exhaust from said exhaust system, an anti-ingestion valve connected in communication with said water conduit, said anti-ingestion valve being operated by differential pressure thereacross to a closed condition when said engine is operating in an on state and said cooling water is being pumped through said water conduit to said exhaust mixing point, said anti-ingestion valve in said closed condition blocking passage of cooling water therepast, said anti-ingestion valve being operated by differential pressure thereacross to an open condition when said engine is in an off state and said cooling water is not being pumped through said water conduit to said exhaust mixing point, said anti-ingestion valve in said open condition permitting passage of air therethrough and communication of atmospheric pressure through said water conduit to said exhaust mixing point to relieve vacuum in said exhaust system wherein said anti-ingestion valve is located along said water conduit in sufficiently close proximity to said exhaust mixing point to quickly communicate vacuum in said exhaust system to said anti-ingestion valve.

5. The anti-ingestion system according to claim 4 wherein said water conduit is connected at a connection point to an exhaust elbow water jacket to flow to said exhaust mixing point, and wherein said anti-ingestion valve is located within 100 ±50 mm of said connection point.

6. An anti-ingestion system for a marine drive having an internal combustion engine having an exhaust system discharging exhaust at an exhaust outlet below the surface of a body of water in which the marine drive is operating, and having a cooling system drawing cooling water from the body of water and pumping the cooling water through a water conduit to an exhaust mixing point to discharge into and mix with exhaust from said exhaust system, an anti-ingestion valve connected in communication with said water conduit, said anti-ingestion valve being operated by differential pressure thereacross to a closed condition when said engine is operating in an on state and said cooling water is being pumped through said water conduit to said exhaust mixing point, said anti-ingestion valve in said closed condition blocking passage of cooling water therepast, said anti-ingestion valve being operated by differential pressure thereacross to an open condition when said engine is in an off state and said cooling water is not being pumped through said water conduit to said exhaust mixing point, said anti-ingestion valve in said open condition permitting passage of air therethrough and communication of atmospheric pressure through said water conduit to said exhaust mixing point to relieve vacuum in said exhaust system wherein said anti-ingestion valve operates between said open and closed conditions in response to 75 ±25 mm water column differential pressure.

7. An anti-ingestion system for a marine drive having an internal combustion engine having an exhaust system discharging exhaust at an exhaust outlet below the surface of a body of water in which the marine drive is operating, and having a cooling system drawing cooling water from the body of water and pumping the cooling water through a water conduit to an exhaust mixing point to discharge into and mix with exhaust from said exhaust system, an anti-ingestion valve connected in communication with said water conduit, said anti-ingestion valve being operated by differential pressure thereacross to a closed condition when said engine is operating in an on state and said cooling water is being pumped through said water conduit to said exhaust mixing point, said anti-ingestion valve in said closed condition blocking passage of cooling water therepast, said anti-ingestion valve being operated by differential pressure thereacross to an open condition when said engine is in an off state and said cooling water is not being pumped through said water conduit to said exhaust mixing point, said anti-ingestion valve in said open condition permitting passage of air therethrough and communication of atmospheric pressure through said water conduit to said exhaust mixing point to relieve vacuum in said exhaust system wherein said anti-ingestion valve is located along said water conduit in sufficiently close proximity to said exhaust mixing point to minimize the amount of water which must be evacuated when said anti-ingestion valve changes from said closed condition to said open condition to in turn provide rapid communication of atmospheric air pressure through said anti-ingestion valve to said exhaust system at said exhaust mixing point.

8. An anti-ingestion system for a marine drive having an internal combustion engine having an exhaust system discharging exhaust at an exhaust outlet below the surface of a body of water in which the marine drive is operating, and having a cooling system drawing cooling water from the body of water and pumping the cooling water through a water conduit to an exhaust mixing point to discharge into and mix with exhaust from said exhaust system, an anti-ingestion valve connected in communication with said water conduit, said anti-ingestion valve being operated by differential pressure thereacross to a closed condition when said engine is operating in an on state and said cooling water is being pumped through said water conduit to said exhaust mixing point, said anti-ingestion valve in said closed condition blocking passage of cooling water therepast, said anti-ingestion valve being operated by differential pressure thereacross to an open condition when said engine is in an off state and said cooling water is not being pumped through said water conduit to said exhaust mixing point, said anti-ingestion valve in said open condition permitting passage of air therethrough and communication of atmospheric pressure through said water conduit to said exhaust mixing point to relieve vacuum in said exhaust system wherein:

said water conduit is connected at a connection point to an exhaust elbow water jacket to flow to said exhaust mixing point;

said anti-ingestion valve is in a side branch conduit extending from said water conduit;

said exhaust elbow water jacket has a lower segment passing said cooling water therethrough from said water conduit;

said side branch conduit at said anti-ingestion valve extends gravitationally above said lower segment of said exhaust elbow water jacket.

9. The anti-ingestion system according to claim 8 wherein said anti-ingestion valve is at a higher gravitational height than said lower segment of said exhaust elbow water jacket.

10. An anti-ingestion system for a marine drive having an internal combustion engine having an exhaust system discharging exhaust at an exhaust outlet below the surface of a body of water in which the marine drive is operating, and having a cooling system drawing cooling water from the body of water and pumping the cooling water through a water conduit to an exhaust mixing point to discharge into and mix with exhaust from said exhaust system, an anti-ingestion valve connected in communication with said water conduit, said anti-ingestion valve being operated by differential pressure thereacross to a closed condition when said engine is operating in an on state and said cooling water is being pumped through said water conduit to said exhaust mixing point, said anti-ingestion valve in said closed condition blocking passage of cooling water therepast, said anti-ingestion valve being operated by differential pressure thereacross to an open condition when said engine is in an off state and said cooling water is not being pumped through said water conduit to said exhaust mixing point, said anti-ingestion valve in said open condition permitting passage of air therethrough and communication of atmospheric pressure through said water conduit to said exhaust mixing point to relieve vacuum in said exhaust system wherein said anti-ingestion valve is connected to said water conduit at a Tee fitting.

11. The anti-ingestion system according to claim 10 comprising a J-conduit having a lower hook leg connected to said water conduit at said Tee fitting, and having an upper leg extending upwardly from said lower hook leg, wherein said anti-ingestion valve is located at said upper leg.

12. The anti-ingestion system according to claim 11 wherein said anti-ingestion valve comprises a movable valve member moving up and down at said upper leg.

13. An anti-ingestion system for a marine drive having an internal combustion engine having an exhaust system discharging exhaust at an exhaust outlet below the surface of a body of water in which the marine drive is operating, and having a cooling system drawing cooling water from the body of water and pumping the cooling water through a water conduit to an exhaust mixing point to discharge into and mix with exhaust from said exhaust system, an anti-ingestion valve connected in communication with said water conduit, said anti-ingestion valve being operated by differential pressure thereacross to a closed condition when said engine is operating in an on state and said cooling water is being pumped through said water conduit to said exhaust mixing point, said anti-ingestion valve in said closed condition blocking passage of cooling water therepast, said anti-ingestion valve being operated by differential pressure thereacross to an open condition when said engine is in an off state and said cooling water is not being pumped through said water conduit to said exhaust mixing point, said anti-ingestion valve in said open condition permitting passage of air therethrough and communication of atmospheric pressure through said water conduit to said exhaust mixing point to relieve vacuum in said exhaust system wherein:

said cooling system comprises a drain valve having an open state draining said cooling system of said cooling water including when said exhaust outlet is below the surface of said body of water;

said anti-ingestion valve is in said open condition when said drain valve is in said open state, whereby to relieve possible vacuum in said cooling system and facilitate said draining of said cooling water therefrom.

* * * * *